US009364108B2

(12) United States Patent
Chasin

(10) Patent No.: US 9,364,108 B2
(45) Date of Patent: Jun. 14, 2016

(54) BEVERAGE LID WITH OVERFLOW CHAMBER

(71) Applicant: David B. Chasin, Los Angeles, CA (US)

(72) Inventor: David B. Chasin, Los Angeles, CA (US)

( * ) Notice: Subject to any disclaimer, the term of this patent is extended or adjusted under 35 U.S.C. 154(b) by 21 days.

(21) Appl. No.: 14/316,041

(22) Filed: Jun. 26, 2014

(65) Prior Publication Data

US 2015/0001232 A1 Jan. 1, 2015

Related U.S. Application Data

(60) Provisional application No. 61/839,569, filed on Jun. 26, 2013.

(51) Int. Cl.
*A47G 19/22* (2006.01)

(52) U.S. Cl.
CPC ..... *A47G 19/2222* (2013.01); *A47G 19/2272* (2013.01); *B65D 2231/022* (2013.01)

(58) Field of Classification Search
CPC ..... A47G 19/2266; A47G 21/18; A47G 19/2222; A47G 19/2272; B65D 2231/022
USPC ..... 220/521, 709, 729
See application file for complete search history.

(56) References Cited

U.S. PATENT DOCUMENTS

| | | | | |
|---|---|---|---|---|
| 3,048,317 | A | 8/1962 | Cochrane et al. | |
| 3,360,161 | A | 12/1967 | Smith | |
| 3,805,991 | A | 4/1974 | Cheladze et al. | |
| 4,308,952 | A * | 1/1982 | Paulucci | B65D 81/3205 206/216 |
| 4,331,255 | A | 5/1982 | Fournier | |
| 4,953,743 | A | 9/1990 | Dart et al. | |
| 5,312,014 | A * | 5/1994 | Hamlin | 220/703 |
| 5,361,935 | A | 11/1994 | Sagucio | |
| 5,381,924 | A * | 1/1995 | Kiefel | 220/709 |
| 5,435,454 | A | 7/1995 | Ishii | |
| 5,540,350 | A | 7/1996 | Lansky | |
| 5,839,598 | A | 11/1998 | Mitchell | |
| 5,979,689 | A | 11/1999 | Lansky | |
| 6,196,411 | B1 | 3/2001 | Nava et al. | |
| 6,199,711 | B1 | 3/2001 | Lansky | |
| 6,305,571 | B1 | 10/2001 | Chu | |
| 6,318,584 | B1 | 11/2001 | Milan | |
| 6,578,726 | B1 | 6/2003 | Schaefer | |
| 6,702,145 | B2 | 3/2004 | Malcolm | |
| 7,111,748 | B2 * | 9/2006 | Cha | A47G 19/065 220/4.27 |
| 7,178,685 | B2 | 2/2007 | Hidalgo et al. | |
| 7,506,756 | B2 | 3/2009 | Bosworth, Sr. | |
| D643,285 | S | 8/2011 | Zomorodi et al. | |
| 8,033,420 | B2 | 10/2011 | Roseblade et al. | |
| 8,074,831 | B2 | 12/2011 | Walker et al. | |

(Continued)

OTHER PUBLICATIONS

International Search Report and Written Opinion in PCT/US2014/044395, Dated Nov. 3, 2014.

*Primary Examiner* — Fenn Mathew
*Assistant Examiner* — James N Smalley
(74) *Attorney, Agent, or Firm* — Knobbe, Martens, Olson & Bear, LLP

(57) ABSTRACT

A beverage container lid is disclosed that includes an overflow chamber for liquid displaced when a straw is inserted through the lid's straw hole. The beverage container lid includes a top layer and a bottom layer that define an overflow chamber between the top and bottom layer. The top layer has a top opening and the bottom layer has a bottom opening, that are aligned along the vertical axis and through which a straw may be inserted into a beverage container to which the beverage container lid is attached.

20 Claims, 2 Drawing Sheets

(56) References Cited

U.S. PATENT DOCUMENTS

| | | | | |
|---|---|---|---|---|
| 8,424,711 | B2 | 4/2013 | Charbonnet et al. | |
| 2003/0178433 | A1 * | 9/2003 | Adams | 220/703 |
| 2003/0218016 | A1 * | 11/2003 | Iskierka | 220/216 |
| 2006/0163251 | A1 | 7/2006 | Kelstrom et al. | |
| 2007/0205204 | A1 | 9/2007 | Novak | |
| 2007/0240580 | A1 | 10/2007 | Lusareta et al. | |
| 2010/0163568 | A1 | 7/2010 | Mucci | |
| 2010/0294772 | A1 | 11/2010 | Judge | |
| 2012/0292340 | A1 * | 11/2012 | Nadon | B65D 75/5894 222/107 |

* cited by examiner

BEVERAGE LID WITH OVERFLOW CHAMBER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

1. Field

The invention relates to a beverage container lid, and more particularly to a beverage container lid with improved spillage prevention that includes a compartment that is capable of storing liquid that overflows out of the straw hole when a straw is inserted through the lid into the beverage.

2. Description of the Related Art

Disposable and reusable plastic lids that fit over the rim of a disposable or reusable beverage container are widely known and used. Existing lids generally consist of a unitary plastic design typically constructed from a single layer of plastic. Existing lids may include a pre-cut incision for the insertion of a straw. Existing lids are convenient to use and inexpensive to manufacture. One problem common to existing lids is that when a beverage container is filled to the top with liquid, there is no space between the liquid and the lid. Accordingly, when a straw is inserted through the lid, liquid displaced by the straw escapes from the gap around the straw onto the top of the lid. This excess liquid presents a hazard or annoyance to the user, as it may spill onto their clothes or require the user to perform the unsanitary act of sipping excess liquid directly from the top of the lid.

SUMMARY

In accordance with one embodiment, an improved beverage container lid includes a chamber to collect excess liquid displaced by a straw. The improved lid has a top layer with a top opening, sized so that a straw may be inserted through the top opening. The lid also has a bottom layer with a bottom opening, also sized so that a straw may be inserted through the bottom opening. The top and bottom openings are positioned in the same circumferential position on the top and bottom layers (e.g., the top and bottom openings being aligned with each other along the same axis). The top and bottom layers are affixed on a perimeter of the top and bottom layer so as to provide a monolithic lid that defines a chamber between the top and bottom layers. Because the top and bottom layers are affixed at their perimeters, the chamber is sealed throughout the periphery of the lid and not permeable to liquid except through the top and bottom openings. Said chamber can receive overflow liquid displaced by the insertion of a straw through the lid into a container attached to the lid that is filled with the liquid, while inhibiting (e.g., preventing) the liquid from escaping onto the top layer of the lid during insertion of the straw.

One embodiment of the present invention includes a hollow overflow chamber.

Another embodiment of the present invention includes a partially filled overflow chamber, such filling comprising an absorbent or otherwise permeable material. Including some filling may offer the additional advantage of preventing liquid from leaking out of the chamber when a cup is tilted or inverted.

Another embodiment of the present invention includes an overflow chamber that includes one or more concentric plastic rings that do not impede the flow of liquid, and are designed to maintain the separation distance between the top and bottom layers.

In accordance with one aspect of the invention, a beverage container lid is removably coupleable with the top rim of a beverage container. The lid comprises a top layer with a top opening sized to receive a straw therethrough, and a bottom layer with a bottom opening sized to receive a straw therethrough, the bottom opening and top opening aligned along an axis. The top layer and bottom layer are attached along a perimeter of the top and bottom layers, the top and bottom layers are spaced apart from each other to define a chamber configured to receive and hold liquid from the container during insertion of the straw through the top and bottom openings in the lid.

In one embodiment of the invention, the improved beverage container lid is composed of plastic. In other embodiments, the improved beverage container may be composed of any material that is suitable for a beverage container lid. The improved beverage container lid may be manufactured through injection molding, casting, or any other suitable method known in the art to form the lid as a unitary, monolithic piece. In an alternative embodiment, the top layer and bottom layer may be formed separately, then stamped together or sealed together using, for example, heat or adhesive to join the top and bottom layers.

The aforementioned chamber formed between the top and bottom layers may be of different sizes. In one embodiment, the top and bottom layers may be attached along the perimeter close to or at the outer edge of the lid. In another embodiment, the top and bottom layers may be attached inside the outer edge of the lid, comprising a chamber that that does not extend to the outer edge of the lid. The size of the chamber is defined at least in part by the radial location at which the top and bottom layers are attached.

The aforementioned chamber formed between the top and bottom layers may be of different shapes. In one embodiment, the chamber may form a ring or donut around the top and bottom opening. In another embodiment, the chamber is box shaped. In yet another embodiment, the chamber is a three-dimensional disc shape. In yet another embodiment, the chamber is formed in the shape of a cone, which would advantageously allow any overflow liquid to run towards the outer perimeter of the chamber and away from the top opening where it could potentially leak out on to the top of the lid.

In one embodiment of the invention, the top opening in the top layer may be formed in a raised portion, the top opening lying in a vertical plane different from the plane of the top layer. This allows for increased chamber volume.

The invention may include an outer catch formed around the perimeter of the lid in order for the lid to removably attach to the lip or outer rim of a beverage container.

BRIEF DESCRIPTION OF THE DRAWINGS

These and other features, aspects, and advantages of this disclosure will now be described in connection with some embodiments of the present disclosure, in reference to the accompanying drawings. The illustrated embodiments, however, are merely examples and are not intended to limit the present disclosure. The following are brief descriptions of the drawings.

DETAILED DESCRIPTION

Figure 1:
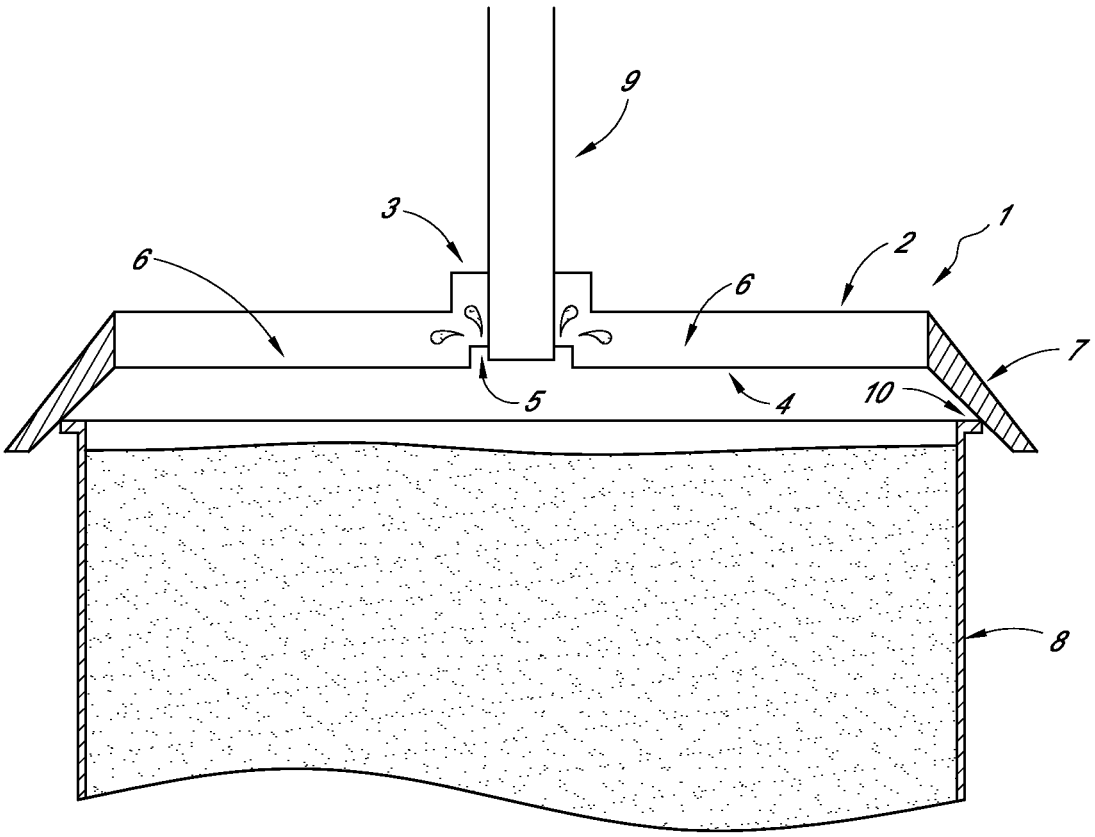
FIG. 1 is a side elevational view of the invention, in use with a full beverage container.
Figure 2:
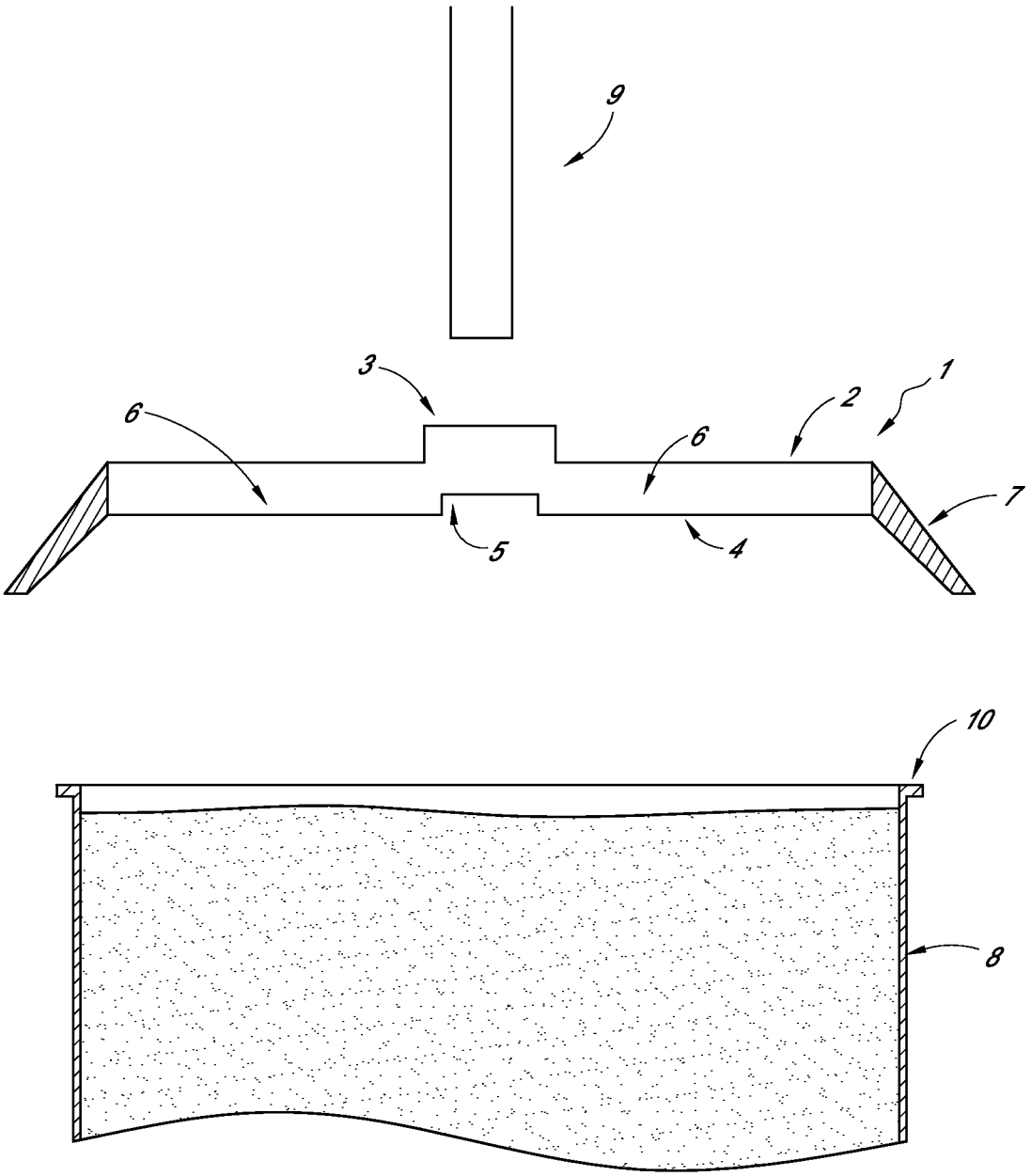
FIG. 2 is an exploded side elevational view of the invention.

FIGS. 1-2 illustrate one embodiment of a beverage container lid 1, wherein the lid includes a top layer 2 with a top opening 3 and a bottom layer 4 with a bottom opening 5, said top and bottom layers defining a chamber 6 therebetween. In one embodiment, the top and bottom layers 2, 4 can be spaced apart by about 1/16 inch from each other. In another embodiment, the top and bottom layers 2, 4 can be spaced apart by about 1/8 inch from each other. In still another embodiment, the top and bottom layers 2, 4 can be spaced apart by about 1/4 inch from each other. However, other suitable spacing between the layers 2, 4 can be used. The chamber 6 is sized to receive and capture liquid displaced by the introduction of a straw 9 through the top and bottom openings 3, 5 and into a beverage container 8 filled with liquid, where the lid 1 is removably coupleable to the top of the container 10 (e.g., to the rim of the container). The lid 1 includes a circumferential outer edge 7 that secures it to the beverage container 10. The top opening 3 and bottom opening 5 can align along an axis to allow for insertion of a straw 9 through both the top opening 3 and bottom opening 5. Advantageously, the chamber 6 substantially captures liquid that is displaced from the container 8 during the insertion of the straw 9 through the openings 3, 5, and the chamber 6 inhibits (e.g., prevents) said liquid from passing through the top opening 3 and onto the top layer 2 of the lid 1. In one embodiment, the lid 1 can be a monolithic (e.g., single piece body without any seams between the top and bottom layers 2, 4). In another embodiment, the top and bottom layers 2, 4 can be joined at a seam (e.g., via a hot weld, adhesive).

In one embodiment, the lid 1 can be made of plastic. However, in other embodiments, the lid 1 can be made of other suitable materials.

In one embodiment, the chamber 6 defines an open cavity (e.g., prior to receiving liquid, as described herein). In another embodiment, the chamber 6 can include an absorbent material (e.g., sponge material) to help absorb liquid that enters the chamber 6 and to further inhibit (e.g., prevent) the passage of liquid onto the top layer 2 upon insertion of the straw 9 through the openings 3, 5.

Of course, the foregoing description is of certain features, aspects and advantages of the present invention, to which various changes and modifications can be made without departing from the spirit and scope of the present invention. Thus, for example, those skilled in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or sub-combinations of the specific features and aspects between and among the different embodiments may be made and still fall within the scope of the invention. Accordingly, it should be understood that various features and aspects of the disclosed embodiments can be combined with or substituted for one another in order to form varying modes of the discussed devices, systems and methods (e.g., by excluding features or steps from certain embodiments, or adding features or steps from one embodiment of a system or method to another embodiment of a system or method).

What is claimed is:

1. A beverage container lid removably coupleable to a beverage container and generally designed to maintain liquid in the beverage container, comprising:

a top layer with a top opening having a diameter less than 25% of a diameter of the top layer and sized to receive a straw therethrough;

a bottom layer with a bottom opening having a diameter less than 25% of a diameter of the bottom layer and sized to receive the straw therethrough, the bottom opening and top opening being concentrically aligned along an axis, wherein the top layer and bottom layer are attached along a perimeter of the top and bottom layers, the top and bottom layers spaced apart from each other to define a chamber configured to receive and hold liquid displaced from the container during insertion of the straw through the top and bottom openings in the lid.

2. The beverage container lid of claim 1, wherein the chamber is hollow.

3. The beverage container lid of claim 1, wherein the chamber comprises a porous material.

4. The beverage container lid of claim 1, wherein the chamber comprises a semi-absorbent material.

5. The beverage container lid of claim 1, wherein the chamber includes a separator that serves to maintain separation distance between the top layer and bottom layer.

6. The beverage container lid of claim 5, wherein the separator comprises one or more concentric plastic rings.

7. A method of reducing liquid overflow from a beverage container upon insertion of a straw through the lid, said method comprising the steps of:

providing a lid removably coupleable to a beverage container, the lid having a chamber defined between a top layer and a bottom layer of the lid, the chamber configured to receive and hold liquid therein, said top layer including a top opening having a diameter less than 25% of a diameter of the top layer and sized to receive a straw through the top opening;

said bottom layer including a bottom opening having a diameter less than 25% of a diameter of the bottom layer and sized to receive a straw through the bottom opening;

said top and bottom openings being concentrically aligned along an axis.

8. The method of claim 7, wherein the overflow chamber is hollow.

9. The method of claim 7, wherein the overflow chamber is comprised of a porous material.

10. The method of claim 7, wherein the overflow chamber is comprised of a semi-absorbent material.

11. The method of claim 7, wherein the overflow chamber includes a separator that serves to maintain separation distance between the top layer and bottom layer.

12. The method of claim 11, wherein the separator is comprised of one or more concentric plastic rings.

13. A beverage container lid removably coupleable to a beverage container, comprising:

a top layer with a first portion configured to receive a straw therethrough, said first portion covering a surface area that is less than 25% of the surface area of the top layer;

a bottom layer with a second portion configured to receive the straw therethrough, said second portion covering surface area that is less than 25% of the bottom layer, the first and second portions aligned along a central axis of the first and second portions, wherein the top layer and bottom layer join along a perimeter of the top and bottom layers, the top and bottom layers spaced apart from each other to define a chamber configured to receive and hold liquid from the container during insertion of the straw through the first and second portions in the lid.

14. The beverage container lid of claim 13, wherein the chamber is hollow.

15. The beverage container lid of claim 13, wherein the chamber comprises a porous material.

16. The beverage container lid of claim 13, wherein the chamber comprises a semi-absorbent material.

17. The beverage container lid of claim 13, wherein the chamber includes a separator that serves to maintain separation distance between the top layer and bottom layer.

18. The beverage container lid of claim 17, wherein the separator comprises one or more concentric plastic rings.

19. The beverage container lid of claim 13, wherein the first portion defines an opening in the top layer and the second portion defines an opening in the bottom layer.

20. The beverage container lid of claim 19, wherein the top and bottom layer form a monolithic piece.

* * * * *